US007166810B2

(12) United States Patent
Hanahara et al.

(10) Patent No.: US 7,166,810 B2
(45) Date of Patent: Jan. 23, 2007

(54) SWITCHING DEVICE AND REMOTE CONTROL TRANSMITTER USING THE SWITCHING DEVICE

(75) Inventors: Tetsuro Hanahara, Fukui (JP); Takaya Nakamura, Fukui (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/357,955

(22) Filed: Feb. 22, 2006

(65) Prior Publication Data

US 2006/0201793 A1 Sep. 14, 2006

(30) Foreign Application Priority Data

Mar. 10, 2005 (JP) ..... 2005-066970

(51) Int. Cl.
*H01H 9/30* (2006.01)

(52) U.S. Cl. ..... 200/11 R; 200/14; 200/11 A; 200/11 DA

(58) Field of Classification Search ..... 200/11 R, 200/14, 11 A–11 DA, 11 TW
See application file for complete search history.

(56) References Cited

U.S. PATENT DOCUMENTS

| | | | | |
|---|---|---|---|---|
| 3,127,636 | A * | 4/1964 | Heider | 264/533 |
| 4,814,743 | A * | 3/1989 | Hanaki | 200/61.39 |
| 5,525,960 | A * | 6/1996 | McCall et al. | 340/438 |
| 6,031,190 | A * | 2/2000 | Tokuda et al. | 200/11 R |
| 6,188,332 | B1 * | 2/2001 | Scarlata | 341/35 |
| 6,404,354 | B1 * | 6/2002 | Decker et al. | 341/35 |

FOREIGN PATENT DOCUMENTS

| | | |
|---|---|---|
| JP | 2005-032450 | 2/2005 |

* cited by examiner

*Primary Examiner*—Kyung Lee
*Assistant Examiner*—Richard K. Lee
(74) *Attorney, Agent, or Firm*—Wenderoth, Lind & Ponack, L.L.P.

(57) ABSTRACT

A switching device and a remote control transmitter using the switching device are provided. In the switching device, a driving body rotating in conjunction with an operation body is provided. This rotation of the driving body provides an electrical contact or separation of a switch. A rotation of the operation body causes a great number of electrical contacts and separations of the switch. The operation as described above provides fine detection of an operation angle of the operation body to provide detection of the operation position with a high accuracy.

10 Claims, 4 Drawing Sheets

SWITCHING DEVICE AND REMOTE CONTROL TRANSMITTER USING THE SWITCHING DEVICE

TECHNICAL FIELD

The present invention mainly relates to a switching device used to operate various electronic devices and a remote control transmitter using the switching device.

BACKGROUND ART

Recently, electronic devices such as the ones for video, audio, and air-conditioning applications have been increasingly sophisticated. Thus, switching devices and remote control transmitters for operating them have been also required to provide diverse and highly-accurate operations.

The conventional switching devices as described above will be described with reference to FIG. 4.

FIG. 4 is a perspective view illustrating a conventional switching device. In FIG. 4, a plurality of wiring patterns (not shown) are formed on upper and lower faces of wiring board 1. Operation body 2 has a disk-like shape and is attached to wiring board 1 so as to be rotatable at the upper face of wiring board 1. At an outer circumference of operation body 2, a plurality of cam units 3 that protrude outwardly are formed with a predetermined interval therebetween.

Furthermore, lever 5 protrudes from switch 4 so that lever 5 can rock relative to insulating resin case 6. Switch 4 is provided so that, by rocking lever 5 to the left and right, a movable terminal (not shown) stored in case 6 is abutted with or separated from a plurality of fixed terminals (not shown) to allow an electronic signal caused by the abutment and separation to be outputted from a terminal unit.

It is noted that switch 4 is a so-called neutral return type switch in which, when an operation force is cancelled after lever 5 is operated by being rocked to the left or right, switch 4 automatically returns to an original neutral position by a spring attached in case 6 (not shown) for example.

Furthermore, switch 4 is provided at the outer circumference of operation body 2 at the upper face of wiring board 1 so that lever 5 is engaged with cam unit 3 of operation body 2. The terminal unit of switch 4 is connected, by being soldered to a predetermined wiring pattern, to a control apparatus (not shown) provided by an electronic component (e.g., microcomputer).

The switching device having the structure as described above is attached to an electronic device or a remote control transmitter with operation body 2 protruding from an operation unit of the device. Then, a wiring pattern of wiring board 1 is electrically connected to an electronic circuit of the device via a connector or the like.

When operation body 2 is rotated and operated in a clockwise or counterclockwise direction in the above structure, lower parts of cam units 3A, 3B, and 3C or the like provided at the outer circumference of operation body 2 are abutted with lever 5 of switch 4 in accordance with the rotation of operation body 2 to cause oscillation of lever 5 to the left or right, thereby providing an electrical contact or separation between a movable terminal and a fixed terminal.

When operation body 2 is rotated through a large angle in the above operation (e.g., when operation body 2 is rotated through a large angle in a clockwise direction), lever 5 of switch 4 is first pressed by cam unit 3A and is rocked to the left. Thereafter, switch 4 automatically returns to its original neutral position. Then, switch 4 is again pressed by cam unit 3C and is rocked to the left. Thus, an electrical contact or separation of switch 4 is performed two times.

An electronic signal caused by this electrical contact or separation is outputted from a plurality of terminal units to the control apparatus. The control apparatus detects a rotational direction and a rotation angle of operation body 2 based on how many times lever 5 is operated by being rocked to the left or right and how many electrical contacts or separations switch 4 has undergone, thereby detecting an operation position of operation body 2. Thus, the conventional switching device has been structured so that sound volume or temperature of a television, audio equipment, or an air conditioner can be increased or decreased or a channel can be selected in accordance with the rotation of rotating operation body 2.

Known information related to the invention of this application includes, for example, that disclosed in Japanese Patent Unexamined Publication No. 2005-32450.

However, in the above conventional switching device, the rotational direction and the rotation angle of operation body 2 are detected by using cam units 3A and 3B provided at the outer circumference of operation body 2 that is operated by being rotated to rock switch 4. Lever 5 of switch 4 is provided between cam units 3A and 3B. An interval between the respective cam units cannot be equal to or smaller than the width of lever 5. For example, when a plurality of cam units 3 outwardly protruding from the outer circumference are arranged with 30 degrees thereamong, the rotation angle of operation body 2 can be detected only with an interval of 30 degrees. Due to this reason, it has been difficult to finely detect an operation position of operation body 2.

SUMMARY OF THE INVENTION

The present invention solves the conventional disadvantage as described above. The present invention provides a switching device that can finely detect an operation position of an operation body and that can be operated with a high accuracy, and a remote control transmitter using the switching device.

In order to solve the conventional disadvantage as described above, the present invention is a switching device comprising: an operation body capable of rotating; a driving body rotating in conjunction with the operation body; and a switch for providing an electrical contact or separation in accordance with the rotation of the driving body, wherein the switching device detects an operation position of the operation body based on the electrical contact or separation of the switch. For example, gears meshing with each other are provided at the outer circumference of the operation body and the outer circumference of the driving body so that one rotation of the operation body causes a few rotations of the driving body. As a result, one rotation of the operation body causes a great number of electrical contacts and separations of the switch. Thus, the operation angle of the operation body can be finely detected and the operation position can be detected with a high accuracy.

The present invention is also a remote control transmitter in which a control apparatus is connected to the above-described switch of the switching device so that the control apparatus causes a transmission apparatus to transmit a remote control signal in accordance with the electrical contact or separation of the switch. The structure as described above provides the remote control transmitter that provides fine detection of the operation position of the operation body to provide the operation with a high accuracy.

DETAILED DESCRIPTION OF THE INVENTION

Hereinafter, an embodiment of the present invention will be described with reference to FIG. 1 to FIG. 3.

Figure 1:
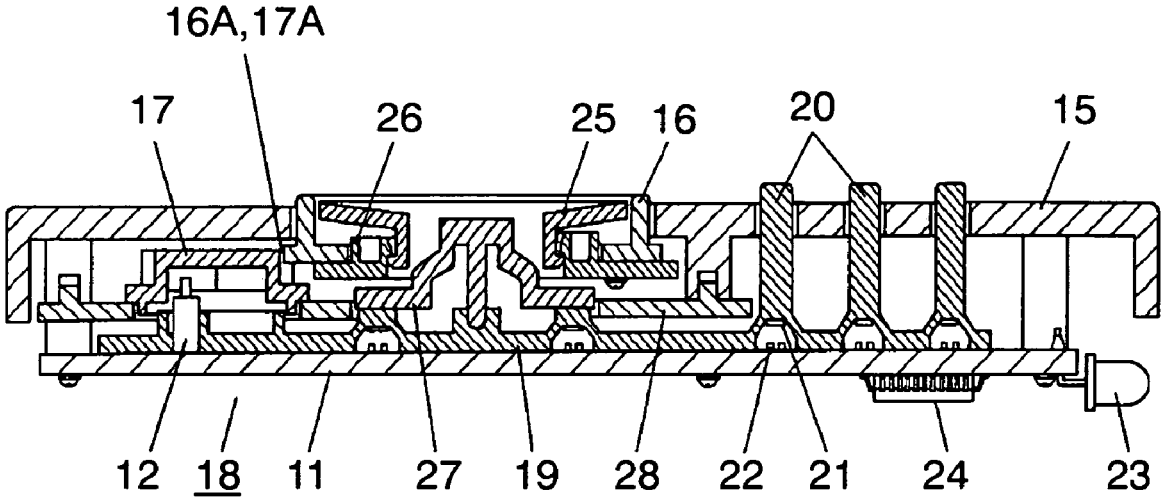
FIG. 1 is a cross-sectional view of a remote control transmitter according to an exemplary embodiment of the present invention.
Figure 2:
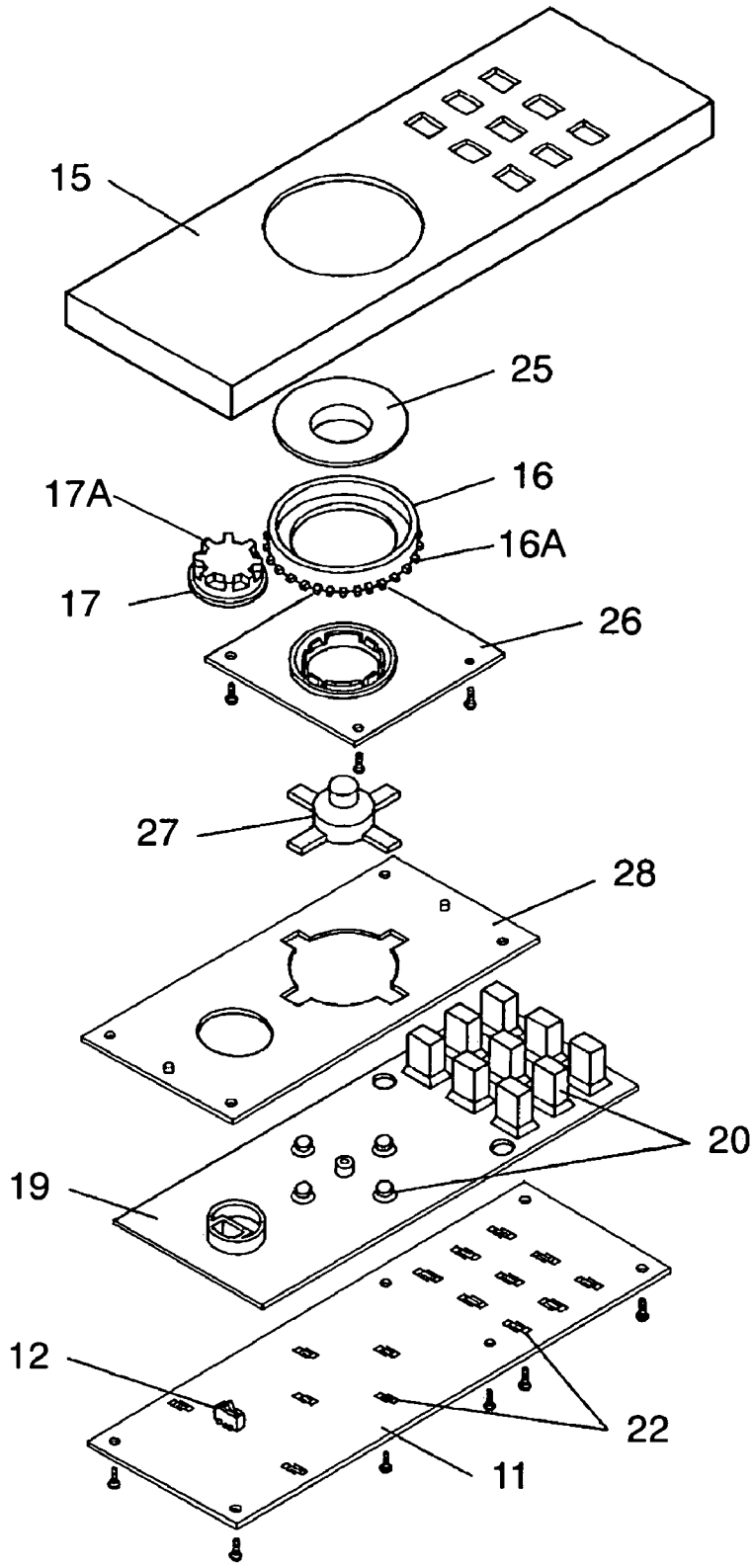
FIG. 2 is an exploded perspective view of the remote control transmitter according to the exemplary embodiment of the present invention.

FIG. 1 is a cross-sectional view of a remote control transmitter according to the exemplary embodiment of the present invention. FIG. 2 is an exploded perspective view of the remote control transmitter according to the exemplary embodiment of the present invention. FIG. 3 is a partial perspective view of a switching device according to an exemplary embodiment of the present invention. In FIG. 1 to FIG. 3, at upper and lower faces of wiring board 11 of paper phenol, glass epoxy or the like, a plurality of wiring patterns (not shown) are formed by copper foil or the like. At the left side of the upper face of wiring board 11, switch 12 is mounted.

Figure 3:
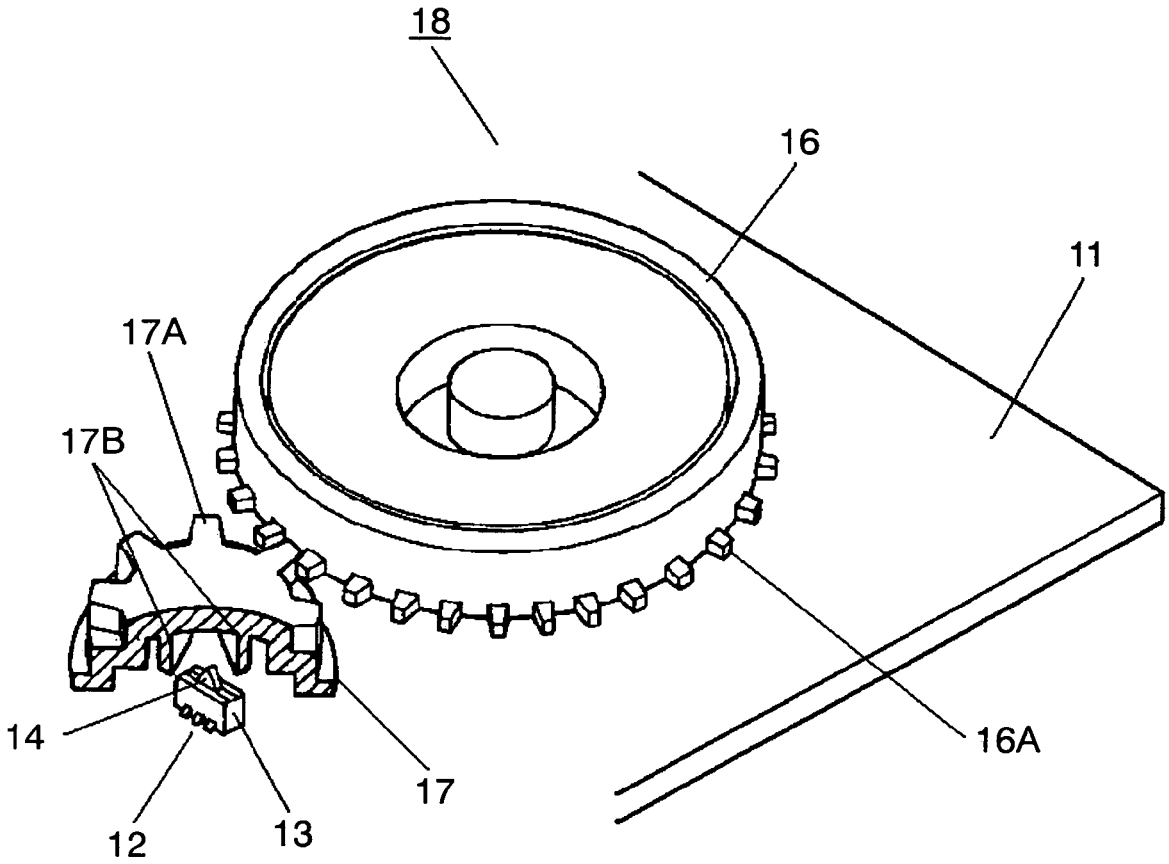
FIG. 3 is a partial perspective view of a switching device according to the exemplary embodiment of the present invention.
Figure 4:
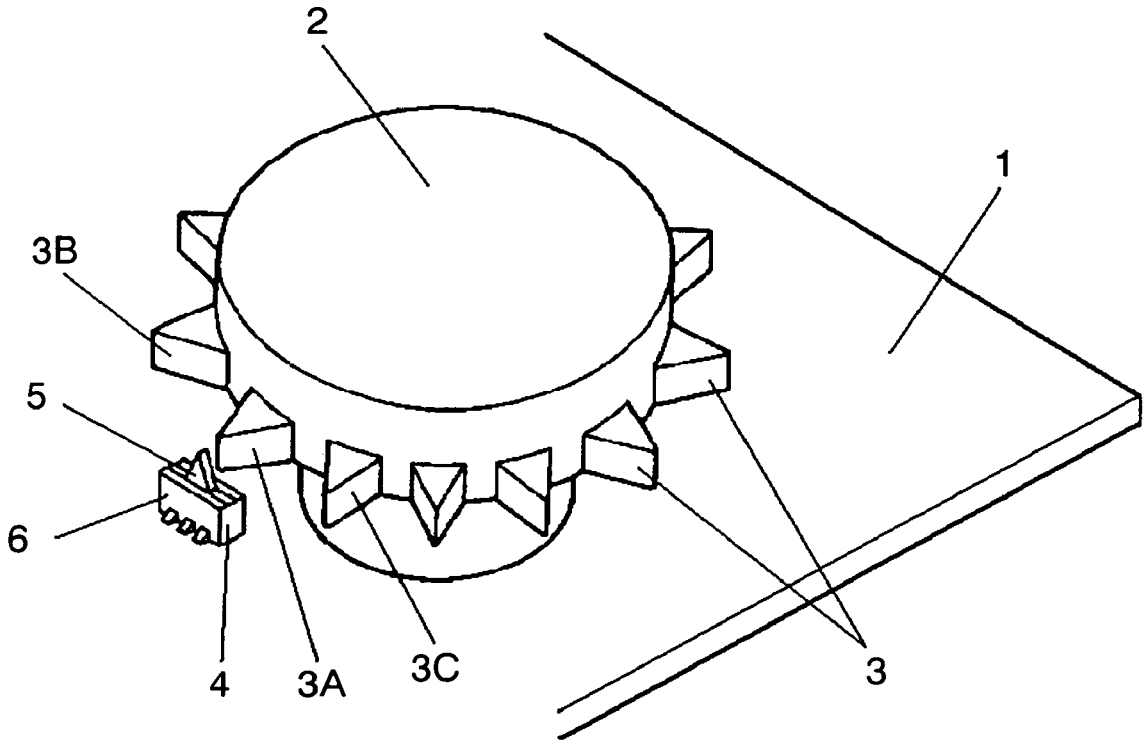
FIG. 4 PRIOR ART
FIG. 4 is a perspective view of a conventional switching device.

As shown in FIG. 3, switch 12 is structured so that a movable terminal (not shown) stored in case 13 is abutted with or separated from a plurality of fixed terminals (not shown) by allowing lever 14 protruding from insulating resin-made case 13 to be rocked to the left and right. Then, an electronic signal caused by the abutment and separation is outputted from a plurality of terminal units.

It is noted that switch 12 is a so-called neutral return type switch in which, when an operation force is cancelled after lever 14 is operated by being rocked to the left or right, switch 12 automatically returns to an original neutral position by a spring attached in case 13 (not shown) for example.

Chassis 15 has a box-like shape and is made of insulating resin such as polystyrene or ABS. Operation body 16 has a circular cylinder-like shape and is made of insulating resin. An upper face of operation body 16 protrudes from an opening at an upper face of chassis 15 so that operation body 16 can be rotated. Gear unit 16A is provided at a lower part of the outer circumference of operation body 16.

Driving body 17 has a disk-like shape and is made of insulating resin. At an upper part of an outer circumference of driving body 17, gear unit 17A is provided that has a fewer number of gears than that of gear unit 16A of operation body 16. Thus, when gear unit 17A is meshed with gear unit 16A, driving body 17 is rotated in conjunction with the rotation of operation body 16.

Switch 12 is provided at an inner circumference of driving body 17. Lever 14 is engaged with a plurality of cam units 17B that are formed at a side face of an inner edge of driving body 17 so as to protrude inwardly with a predetermined interval therebetween. An electrical contact or separation of switch 12 is performed in accordance with the rotation of driving body 17.

In this manner, switching device 18 is structured.

Press body 19 is a sheet made of rubber, elastomer or the like. Press body 19 is placed on the upper face of wiring board 11. At the center part or the right part of press body 19, a plurality of keys 20 having a dome-like shape having a thinner thickness are provided. At the lower face of each key 20, movable contact point 21 is provided by carbon or the like.

At the center part or the right part of wiring board 11, a plurality of fixed contact points 22 of carbon or the like are provided that are opposed to movable contact points 21 with predetermined spacing thereamong. At the lower face of wiring board 11, there are provided transmission apparatus 23 that transmits a remote control signal by an electronic component (e.g., light-emitting diode) and control apparatus 24 (e.g., microcomputer) that is connected via a wiring pattern to a terminal unit of switch 12 and fixed contact point 22.

The upper face of operation body 16 is attached with cover 25 and the lower face thereof has retention body 26. Tilting body 27 is provided on fixed contact point 22 at the center part of the upper face of wiring board 11. Cover body 28 is provided at the left part of press body 19.

In this manner, a remote control transmitter is structured.

When operation body 16 of switching device 18 is rotated in a clockwise or counterclockwise direction in the structure as described above as shown in FIG. 3, driving body 17 having gear unit 17A meshed with gear unit 16A is also rotated in conjunction with the rotation of operation body 16. A plurality of cam units 17B projected at the side face of the inner edge of driving body 17 are abutted with lever 14 of switch 12. Then, lever 14 is rocked to the right or left, thereby providing an electrical contact or separation of the movable terminal with the fixed terminal in switch 12.

When the rotation angle in the operation is large (e.g., when operation body 16 is rotated in a clockwise direction with a large angle), lever 14 of switch 12 is first pressed by a first cam unit 17B and is rocked to the right and subsequently once automatically returns to its original neutral position. Thereafter, lever 14 of switch 12 is pressed by a second cam unit 17B and is again rocked to the right. As a result, an electrical contact or separation of switch 12 is performed two times. Then, an electronic signal of switch 12 caused by the electrical contact or separation is outputted from a plurality of terminal units of switch 12 to control apparatus 24. Control apparatus 24 detects the rotational direction and the rotation angle of operation body 16 based on how many times lever 14 was rocked to the left and/or right and how many times the electrical contact(s) or separation(s) was/were performed. As a result, the operation position of operation body 16 is detected.

Cam units 17B of driving body 17 that rock lever 14 of switch 12 for operation cannot be arranged with an interval equal to or smaller than the width of lever 14. The reason is that the respective cam units require a space for storing lever 14. However, driving body 17 has gear unit 17A that is formed with a smaller number of teeth than that of gear unit 16A of operation body 16 that is meshed therewith. Thus, driving body 17 is rotated with a larger rotation angle than that of operation body 16.

When cam units 17B are arranged at 30 degree intervals, and gear unit 17A is provided with half the number of teeth as gear unit 16A for example, one rotation of driving body 17 causes twelve electrical contacts and separations of switch 12. Since one rotation of operation body 16 causes two rotations of driving body 17, one rotation of operation body 16 causes twenty four electrical contacts and separations of switch 12. Therefore, the rotation angle of operation body 16 can be detected with an interval of 15 degrees.

Specifically, by providing driving body 17 that rotates in conjunction with operation body 16 so that driving body 17 is rotated few times in response to one rotation of operation body 16 to provide electrical contacts and separations of switch 12 by cam units 17B of driving body 17, a great number of electrical contacts and separation of switch 12 can be obtained in response to one rotation of operation body 16. Thus, the operation of operation body 16 can be finely detected and the operation can be detected with a high accuracy.

Then, in accordance with the electrical contacts and separations of switch 12 by the rotations of operation body 17, control apparatus 24 allows transmission apparatus 23 to transmit an infrared ray remote control signal. For example, expansion or reduction of a screen (e.g., television, video), fast-forwarding and rewinding of a tape, or the movement of a cursor displayed on a screen for example can be remote-controlled.

When a predetermined key 20 of the remote control transmitter is depressed or tilting body 27 is tilted, the dome-like part having a thinner thickness is elastically deformed. This causes movable contact point 21 to move downward and to have a contact with fixed contact point 22, thereby providing an electrical contact or separation of fixed contact points 22. Then, in accordance with the electrical contacts and separations of fixed contact point 22, control apparatus 24 allows transmission apparatus 23 to transmit a predetermined infrared ray remote control signal. By this remote control signal, sound volume or temperature of audio equipment or an air conditioner or the like is increased or decreased or a channel is selected for example.

By placing switch 12 at the inner circumference of driving body 17, the switching device can be smaller than that with switch 12 placed at the outer circumference of driving body 17. Furthermore, switch 12 can have improved dust resistance and improved waterproofing.

The above description provides gear units 16A and 17A at the outer circumferences of operation body 16 and driving body 17 so that driving body 17 is rotated in conjunction with operation body 16 with gear units 16A and 17A being meshed with each other. However, another configuration also may be used in which an elastic part having high friction (e.g., rubber) is provided at the outer circumference of operation body 16 or driving body 17 so that driving body 17 is rotated in conjunction with operation body 16 with the elastic part being pressure-welded. Alternatively, a configuration also may be used in which operation body 16 is connected with driving body 17 by a rubber belt or the like so that driving body 17 is rotated in conjunction with operation body 16.

Furthermore, switch 12 is not limited to the one as described above in which lever 14 is rocked to provide an electrical contact or separation in switch 12. Depression or sliding operation also may be usable so long as switch 12 repeatedly has electrical contacts and separations in accordance with the rotations of driving body 17.

A switching device and a remote control transmitter using the switching device according to the present invention can detect an operation position of an operation body by finely detecting the operation angle of the operation body. A switching device and a remote control transmitter using the switching device according to the present invention can be mainly useful to operate various electronic devices.

The invention claimed is:

1. A switching device comprising:

an operation body arranged to rotate about a first rotary axis;

a driving body arranged to rotate about a second rotary axis in conjunction with rotation of said operation body about said first rotary axis; and a switch for providing an electrical contact or separation in accordance with rotation of said driving body;

wherein said switching device detects an operation position of said operation body based on the electrical contact or separation of said switch;

wherein said first rotary axis is offset from said second rotary axis; and wherein said operation body and said driving body are arranged so that rotation of said operation body through a first rotational angle results in rotation of said driving body through a second rotational angle greater than said first rotational angle.

2. The switching device according to claim 1, wherein said switch is provided within an inner periphery of said driving body; and a plurality of cam units are provided at a side face of an inner edge of said inner periphery of said driving body.

3. The switching device according to claim 2, wherein said switch comprises a movable lever movable between first and second positions to cause the electrical contact and separation, respectively; and said cam units are engagable with said lever upon rotation of said driving body to cause movement of said moveable lever between said first and second positions.

4. The switching device according to claim 2, wherein said cam units are engagable with said switch upon rotation of said driving body to cause the electrical contact and separation of said switch.

5. A remote control transmitter comprising:

a switching device including an operation body arranged to rotate about a first rotary axis, a driving body arranged to rotate about a second rotary axis in conjunction with rotation of said operation body about said first rotary axis, and a switch for providing an electrical contact or separation in accordance with rotation of said driving body, wherein said switching device detects an operation position of said operation body based on the electrical contact or separation of said switch, wherein said first rotary axis is offset from said second rotary axis, and wherein said operation body and said driving body are arranged so that rotation of said operation body through a first rotational angle results in rotation of said driving body through a second rotational angle greater than said first rotational angle;

a control apparatus connected to said switch of said switching device; and wherein said control apparatus is operable to cause transmission of a remote control signed based on the electrical contact or separation of said switch.

6. The remote control transmitter according to claim 5, wherein said switch is provided within an inner periphery of said driving body; and a plurality of cam units are provided at a side face of an inner edge of said inner periphery of said driving body.

7. The remote control transmitter according to claim 6, wherein said switch comprises a movable lever movable between first and second positions to cause the electrical contact and separation, respectively; and said cam units are engagable with said lever upon rotation of said driving body to cause movement of said moveable lever between said first and second positions.

8. The remote control transmitter according to claim 6, wherein said cam units are engagable with said switch upon rotation of said driving body to cause the electrical contact and separation of said switch.

9. The remote control transmitter according to claim 6, further comprising a transmission apparatus operably coupled to said control apparatus to transmit the remote control signal.

10. The remote control transmitter according to claim 5, further comprising a transmission apparatus operably coupled to said control apparatus to transmit the remote control signal.

* * * * *